United States Patent [19]

Feldman et al.

[11] Patent Number: 4,480,459

[45] Date of Patent: Nov. 6, 1984

[54] ROLLING MILL

[75] Inventors: Hugo Feldman, Alsdorf-Warden, Fed. Rep. of Germany; Heinz Güttinger, Schaffhausen, Switzerland

[73] Assignee: Escher Wyss Aktiengesellschaft, Zurich, Switzerland

[21] Appl. No.: 439,063

[22] Filed: Nov. 3, 1982

[30] Foreign Application Priority Data

Nov. 11, 1981 [CH] Switzerland ..... 7252/81

[51] Int. Cl.[3] ..... B21B 13/14; B21B 31/32

[52] U.S. Cl. ..... 72/243; 29/113 AD; 29/116 AD; 72/245; 100/162 B

[58] Field of Search ..... 72/243, 245, 241; 29/116 AD, 113 AD; 100/162 B

[56] References Cited

U.S. PATENT DOCUMENTS

| | | | |
|---|---|---|---|
| 3,461,705 | 8/1969 | Neumann | 72/243 |
| 3,518,858 | 7/1970 | Kamata | 72/243 X |
| 3,802,044 | 4/1974 | Spillmann et al. | 29/116 AD X |
| 3,885,283 | 5/1975 | Biondetti | 29/116 AD |
| 4,059,976 | 11/1977 | Christ et al. | 29/116 AD X |

*Primary Examiner*—Francis S. Husar
*Assistant Examiner*—Steven B. Katz
*Attorney, Agent, or Firm*—Werner W. Kleeman

[57] ABSTRACT

A rolling mill is disclosed containing a roll stand equipped with two work rolls which are braced at back-up or support rolls which can be constructed as controlled deflection rolls. The work rolls are equipped at their opposed ends with bending devices for applying a bending moment. Simplified designs of the rolling mill contemplate constructing one of the back-up or support rolls as a solid roll. Furthermore, one of the work rolls can be omitted.

6 Claims, 10 Drawing Figures

ROLLING MILL

BACKGROUND OF THE INVENTION

The present invention relates to a new and improved construction of rolling mill for rolling materials substantially in web form.

Generally speaking, the rolling mill of the present development, which serves to roll web-like materials, is of the type comprising at least one work roll which coacts with a counter roll. Between the work roll and the counter roll there is passed the material which is to be rolled. Additionally, there is provided a support or back-up roll at which there is supported or braced the work or working roll. The support roll is constituted by a controlled deflection roll—also referred to in the art as a roll with bending or sag compensation—which contains a roll shell rotatable about a stationary roll support or beam. The roll shell is supported at the roll support or beam by means of support or pressure elements, the supporting force of which can be controlled individually or in groups.

Such type of rolling mill is known, for instance, from U.S. Pat. No. 4,059,976, granted Nov. 29, 1977. In contrast to conventional roll stands equipped with solid support rolls, the rolling mills of the aforementioned type allow for a particularly good influencing of the rolling operation as concerns the thickness and, in particular, the evenness of a rolled metallic web, for instance, a cold-rolled aluminum foil. These advantages are attributable to the ability to control the contact or pressing force of the support or pressure elements individually or in groups.

With equipment of this type, which is intended for use with extremely high rolling forces, such as, for instance, for the cold-rolling of iron or ferrous materials, it has been found to be disadvantageous that the required supporting forces of the support or pressure elements become extremely irregular, attaining peak values which require unrealistically high pressures of the hydraulic pressurized fluid medium acting upon the support or pressure elements.

SUMMARY OF THE INVENTION

Therefore, with the foregoing in mind it is a primary object of the present invention to provide a new and improved construction of rolling mill of the aforementioned type which is not afflicted with the previously discussed drawbacks and limitations of the prior art.

Another and more specific object of the present invention aims at the provision of a new and improved construction of rolling mill which, even in the presence of extremely high rolling forces, exhibits essentially uniform supporting forces of the support or pressure elements, so that there are avoided the high peak values, and additionally, there is retained a certain degree of freedom for accomplishing a fine regulation by means of the support or pressure elements.

Yet a further important object of the present invention is directed to a new and improved construction of rolling mill of the character described which is relatively simple in design, quite economical to manufacture, extremely reliable in operation, not readily subject to breakdown or malfunction, and requires a minimum of maintenance and servicing.

Now in order to implement these and still further objects of the invention, which will become more readily apparent as the description proceeds, the rolling mill of the present development is manifested by the features that the work or working roll is provided at its opposed ends with bending devices for applying a bending moment which can be controlled during operation of the rolling mill.

Basically, this technique is known as such from the art of rolling mills used for rolling metals. However, in that environment of use such technique can not be completely employed because of the presence of the rigid support or back-up rolls, so that there must be resorted to the use of further measures for influencing the local rolling forces at the rolled material. As a general rule, this means a localized influencing of the temperature of the work or working roll which, however, is associated with a great deal of inertia or time-lag.

With the rolling mill of the present development there is realized, through the use of this technique, an additional influencing of the forces prevailing at the roll nip or gap, rendering possible a compensation of the required supporting forces of the support or pressure elements. Hence, there are avoided pressure peaks, and at the same time there is obtained a certain degree of freedom of play with respect to the supporting forces which can serve for the localized influencing of the rolling force. It is possible to advantageously dispense with the cumbersome technique of localized influencing of the temperatures of the work or working rolls. Influencing the supporting forces of the support or pressure elements is associated with the notable advantage that it is effective immediately and can be precisely controlled, whereas influencing the temperature as aforedescribed is associated with high inertia, and at the same time there is absent any exact adjustability.

Preferably, the counter roll likewise can be constituted by a work or working roll, at the opposed ends of which there are effective bending devices for the application of a bending moment which can be controlled during mill operation, and such work roll is supported at a support or back-up roll.

According to a preferred design of the invention, this support or back-up roll likewise can be constituted by a controlled deflection roll having a roll shell rotatable about a stationary roll support or beam. The roll shell is supported at the stationary roll support or beam by means of support or pressure elements, the supporting forces of which can be controlled individually or in groups.

In this way there is attained an arrangement which is symmetrical with respect to the rolling plane, and which from the standpoint of the control thereof is particularly simple. However, it should be understood that also other embodiments are conceivable, wherein, for instance, one of the support or back-up rolls can be designed in conventional manner as a solid roll. There is even possible a construction where there can be dispensed with a second work or working roll. In such case, the rolled material is passed between the work roll and a solid counter roll having the diameter of a support or back-up roll.

In all of these instances the work roll and/or the support roll can possess a substantially cylindrical configuration. Such constitutes the simplest design which, in most instances, is quite satisfactory and suitable for most fields of application and encountered operating conditions.

However, it is also possible to design the work roll and/or the support or back-up roll to be crowned or domed. In this way there is obtained a further series of possibilities for influencing the supporting forces of the support or back-up rolls as well as the requisite bending moments at the ends of the work roll.

According to a versatile construction of the rolling mill having a particularly wide field of application, the bending moments of the work rolls and the support or supporting forces of the support or pressure elements of the support rolls can be influenced independently of one another. Consequently, there are obtained further possibilities for influencing the rolling forces.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
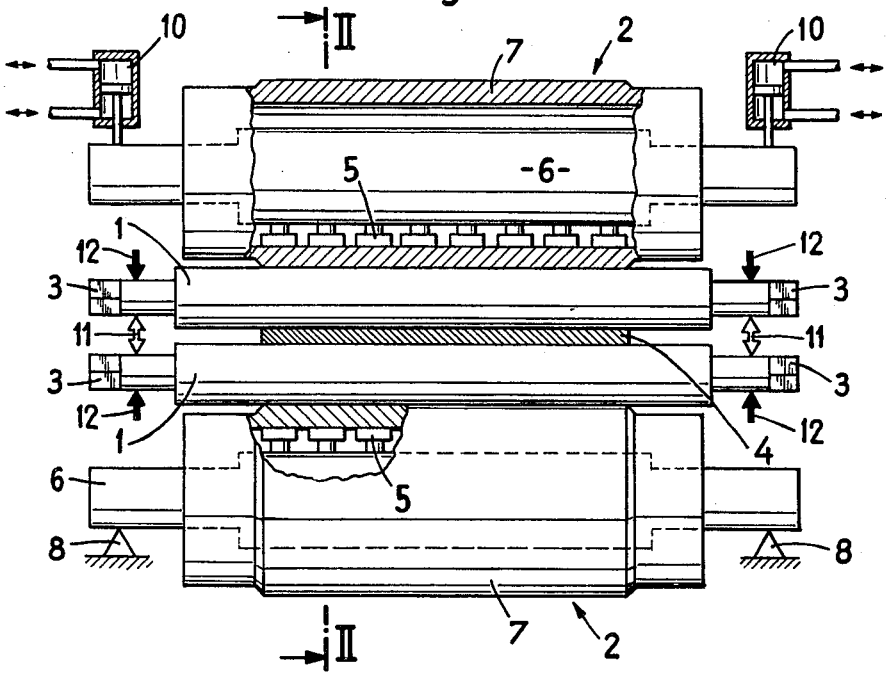
FIG. 1 schematically illustrates a so-called four-high roll stand or rolling mill containing two work or working rolls and two controlled deflection rolls constituting support or back-up rolls.

Describing now the drawings, it is to be understood that only enough of the construction of the rolling mill of the present development has been shown therein as needed for those skilled in the art to readily understand the underlying principles and concepts of the present development, while simplifying the illustration of the drawings. Turning attention now specifically to FIG. 1, there is depicted therein a so-called four-high roll stand or rolling mill containing two work or working rolls 1 which are braced or supported at controlled deflection rolls 2 constituting support or back-up rolls. Between the work rolls 1, which are driven in any suitable fashion, as has been schematically illustrated by the drive ends 3 of such work rolls 1, there is located a rolled material web 4. This material web 4 is a metallic web, such as for instance a cold-rolled aluminum foil, or a cold-rolled steel plate.

The controlled deflection rolls 2, which serve as support or back-up rolls, in the embodiment under discussion, may be designed in the manner disclosed in detail in U.S. Pat. No. 3,802,044, granted Apr. 9, 1974, and contain piston-like support or pressure elements 5. These support or pressure elements 5 are guided in here not particularly visible suitable bores or cylinders provided in a stationary roll support or beam 6, there being effective at such bores or cylinders containing the support or pressure elements 5 a suitable hydraulic pressurized fluid medium, typically oil, which is infed by means of not particularly illustrated infeed bores or the like. The support or pressure elements 5 act by means of their supporting forces at the inner surface of a rotatable roll shell 7 which is rotatably mounted about the stationary roll support or beam 6.

As already explained at the outset of this disclosure, a four-high roll stand of this type is known from U.S. Pat. No. 4,059,976, granted Nov. 29, 1977. As also explained previously, the illustrated exemplary embodiment of controlled deflection roll is known from the aforementioned U.S. Pat. No. 3,802,044, granted Apr. 9, 1974, wherein there have also been described in detail the function of the controlled deflection roll and the support or pressure elements.

As again will be evident by referring to FIG. 1, the stationary roll support or beam 6 of the lower controlled deflection roll 2 is fixedly supported in a not particularly illustrated framework of the roll stand of the rolling mill, which here has been generally indicated simply by the supports 8. The opposite ends of the stationary roll support 6 of the upper controlled deflection roll 2 are provided with hydraulic press or pressing cylinders 10. However, it is also conceivable to use a different design, for instance as has been described in the aforementioned U.S. Pat. No. 4,059,976, wherein the pressing or contact force for the rolling operation can be directly furnished by the support or pressure elements 5. Also, as will be recalled the rolls 1 and 2 or individual selected ones thereof may be constituted, as desired, by cylindrical rolls or crowned rolls.

As has been illustrated by the double-headed arrows 11 and the solid black arrows 12, there can be applied to the opposite ends of the work rolls 1 forces which effect a bending of these ends of the work rolls 1 in one or the other direction.

Figure 3:
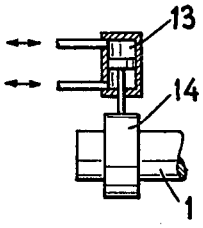
FIG. 3 is a schematic illustration of a force-applying device for applying a bending force at an end of a work roll.
Figure 4:
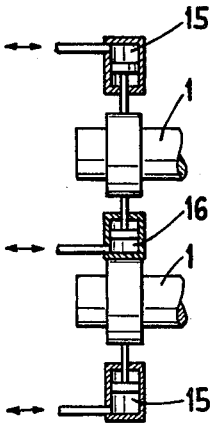
FIG. 4 schematically illustrates a further embodiment of such type of bending force-applying device or arrangement.

FIG. 3 illustrates, by way of example, a piston-and-cylinder mechanism 13 which acts by means of a ring member 14 upon an end of the work roll 1 and, depending upon the direction of application of the force controlled by the not particularly referenced fluid lines constituting control means for the piston-cylinder mechanism 13, can exert a respective force in the one or the other direction of the double-headed arrows 11 and also a force corresponding to the direction of the arrows 12. The same holds true for the bending moment-applying mechanism or arrangement depicted in FIG. 4 which illustrates the piston-and-cylinder mechanisms or units 15 and 16.

Figure 5:
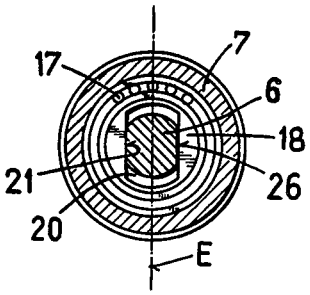
FIG. 5 schematically illustrates details of a moveable guide means of a rotatable roll shell at a stationary roll support or beam of the controlled deflection roll.
Figure 6:
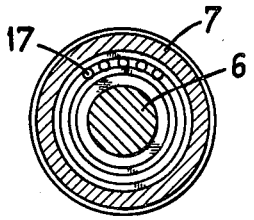
FIG. 6 is an illustration, corresponding to the showing of FIG. 5, of a mounting or bearing arrangement of the rotatable roll shell at the stationary roll support or beam without radial mobility.

As already explained, FIGS. 5 and 6 depict two possible constructions of mounting or bearing arrangements for the rotatable roll shell 7 at the stationary roll beam or support 6.

With the embodiment of FIG. 5, there is arranged at the ends of the rotatable roll shell 7 a respective roller bearing 17 or other suitable anti-friction bearing means, in which there is mounted a guide disk 18 or equivalent guide structure having an elongate or lengthwise extending slot member 20. This elongate slot member 20 is provided with planar lateral guide surfaces 21 which coact with likewise planar or substantially flat guide surfaces 26 of the roll support or beam 6. This type of mounting of the rotatable roll shell 7 at the stationary roll support or beam 6 has been described in detail in U.S. Pat. No. 3,885,283, granted May 27, 1975, and affords a mobility of the rotatable roll shell 7 in relation to the stationary roll beam or support 6 in the direction of a rolling plane E. This renders possible, for instance, the aforementioned formation of the pressing force of the roll stand by means of the support or pressure element 5, so that there can be dispensed with the need for the external press cylinders 10.

With the embodiment depicted in FIG. 6, the rotatable roll shell 7 is mounted directly at the stationary roll support or beam 6 by means of roller bearings 17 or equivalent anti-friction bearing means. This design has been described in detail in the aforedescribed U.S. Pat. No. 3,802,044. In this case there is dispensed with the aforementioned mobility of the rotatable roll shell 7 in relation to the stationary roll support 6, so that there are required the external press or pressing cylinders 10. Instead, there exists for instance a possibility of introducing additional forces by means of the mounting or bearing arrangement 17 at the roll shell 7.

Figure 2:
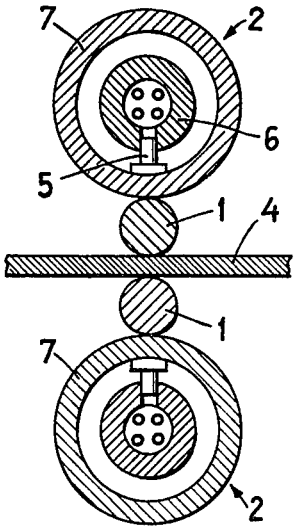
FIG. 2 is a cross-sectional view of the arrangement of FIG. 1, taken substantially along the section line II—II thereof.
Figure 7:
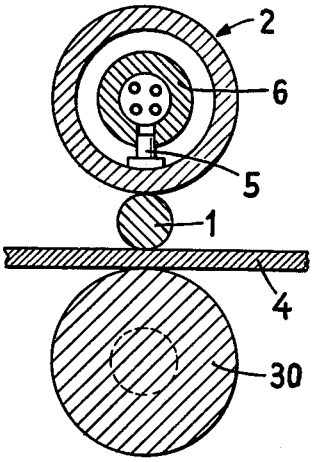
FIG. 7 is a sectional view, corresponding to the illustration of FIG. 2, of a particularly simple construction of inventive rolling mill.
Figure 8:
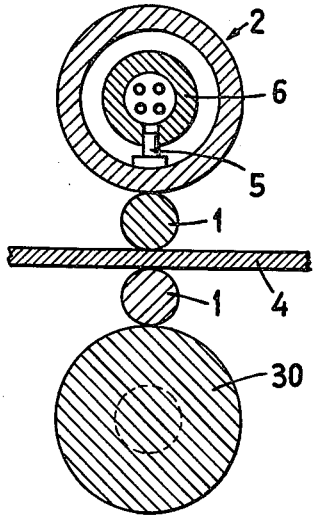
FIG. 8 is a sectional view, again corresponding essentially to the showing of FIG. 2, of a further embodiment of the invention.

FIGS. 7 and 8 illustrate exemplary embodiments of the inventive rolling mill which are simplified in relation to the embodiments depicted in FIGS. 1 and 2.

Thus, in the arrangement of FIG. 7 the work roll 1 which is supported at the back-up or controlled deflection roll 2 coacts with a solid counter roll 30.

With the embodiment of FIG. 8, there is provided a second work roll 1 which is braced or supported at a counter roll 30, which in this case, works as a support or back-up roll.

Figure 9:
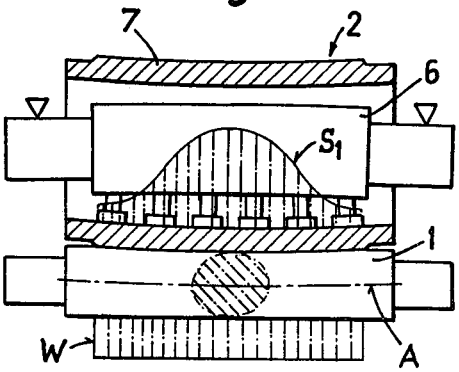
FIGS. 9 and 10 are schematic diagrams serving to explain a possible mode of operation of the inventive rolling mill.
Figure 10:
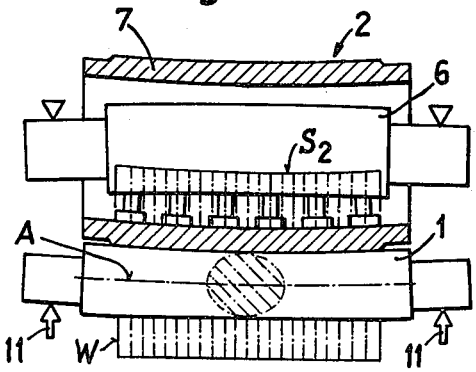

FIGS. 9 and 10 serve to explain the most important mode of operation of the inventive equipment. Specifically, in FIG. 9 there have been shown the force conditions prevailing in one-half of a four-high roll stand without any work roll bending, whereas FIG. 10 shows the corresponding course of the forces with the inventive work roll bending.

In such FIGS. 9 and 10 there has been shown in broken sectional lines a phenomenon arising at the work rolls 1 and, specifically which occurs at roll stands operating at extremely high rolling forces. Although the lower edges of the work rolls 1 have been illustrated as being planar and loaded with a uniform rolling force, the upper edges of such work rolls, and thus, also their axes A have been illustrated as being curved or bent. The cylindrical work rolls 1 are namely deformed into an oval configuration at their central region by virtue of the large prevailing rolling forces, such oval configuration running-out into the original circular shape in the direction of the opposite ends of the rolls. In order to obtain this configuration and at the same time also a uniform pressing force of the roll shell 7 upon the work roll 1, the support or supporting forces of the support or pressure elements 5 must have a course as the same has been generally schematically indicated by a line S1 in FIG. 9. At the center of the roll there prevails a maximum of the support forces which, in many instances, can attain values which make it impossible, or at least extremely difficult, to attain a realization thereof by hydraulic techniques with the aid of a pressurized fluid medium. However, by applying bending moments at the ends of the work roll 1 it is possible to obtain a course of the supporting forces of the support or pressure elements 5 in the roll approximately according to the line S2 of FIG. 10, which is appreciably more uniform and particularly avoids the presence of increased maximum forces. The thus obtained degree of freedom of the support forces can be beneficially employed for carrying out localized corrections, which heretofore had to be undertaken by thermally influencing the work rolls.

Both of the diagrams of FIGS. 9 and 10 correspond to exemplary embodiments of rolls utilizing mounting of the roll shell 7 in the manner depicted and described in conjunction with FIG. 5. However, it would be possible in principle, to also use mounting arrangements of the type shown in FIG. 6, wherein, for instance, through the use of conventional regulation devices there can be ensured that the forces of the press cylinders 10 and the support elements 5 remain in equilibrium in such a manner that the roll bearings 17 are load relieved.

In principle, there are also conceivable exemplary embodiments wherein, by carrying out an intentional loading of the roller bearing 17 with a mounting arrangement of the type depicted in FIG. 5, there can be introduced forces into the roll shell 7, so that its bending-through can be augmented in a desired direction. However, it is to be observed that the roller bearings must be dimensioned to handle the extremely high forces which arise.

As already explained, the control of the support or supporting forces of the support elements 5 can be accomplished essentially symmetrically with respect to the rolling plane of the rolled material or web 4, i.e., the support elements 5 arranged in superimposed relationship in a vertical line or groups of such support elements can have in each case the same force or forces deviating from one another by a correction value, which, for instance, takes into account the inherent weight of the moveable parts. However, in principle it is also possible to carry out a control of these elements as well as the bending forces independent of one another, which affords further possibilities for influencing the forces effective at the rolling nip or gap. For instance, each of the work rolls 1 may be provided with force-applying devices, for example defined by piston-and-cylinder units 13 and their associated ring members 14 as shown and described with reference to FIG. 3, acting independently of one another instead of in coordination or a predetermined correlation to one another. It is also possible to provide the work rolls 1 with moment-applying mechanisms or units, for instance defined by piston-and-cylinder mechanisms or units 15 and 16 as shown and described with reference to FIG. 4 and to appropriately control the action of such mechanisms 15 and 16 independently of one another.

Although the invention has been described, by way of example and not limitation, in conjunction with an apparatus of the type depicted in FIGS. 1 and 2 for the rolling of metals, it is to be understood that the invention is in no way limited to such field of use. Thus, it also can be beneficially employed in rolling mills for rolling plastic webs, again by way of example. For this purpose there is particularly suitable, for instance, the simple construction of apparatus as has been depicted in FIG. 7.

While there are shown and described present preferred embodiments of the invention, it is to be distinctly understood that the invention is not limited thereto, but may be otherwise variously embodied and practiced within the scope of the following claims. Accordingly,

What we claim is:

1. A rolling mill for rolling substantially web-like materials, comprising;

at least one work roll;

a counter roll with which cooperates said at least one work roll;

said work roll and said counter roll defining a press nip for the material to be rolled;

a support roll in engagement with said work roll;

said support roll comprising a controlled deflection roll;

said controlled deflection roll having a length of extent and comprising:

a stationary roll support;

a roll shell rotatable about said stationary roll support; and support elements supporting said rotatable roll shell at said stationary roll support by exerting supporting forces therebetween;

bending devices coacting with said work roll at opposite ends thereof for applying a bending moment thereto; and means connected to said bending devices for actuation thereof.

2. The rolling mill as defined in claim 1, wherein:

said counter roll comprises a further work roll;

bending devices provided at the opposite ends of said counter roll constituting a further work roll in order to apply bending moments thereto; and a support roll at which there is supported said further work roll.

3. The rolling mill as defined in claim 2, wherein:

said support roll of said further work roll comprises a controlled deflection roll;

said controlled deflection roll of said support roll or said further work roll comprising:

a stationary roll support;

a rotatable roll shell rotatable about said stationary roll support; and support elements for supporting said rotatable roll shell at said stationary roll support.

4. The rolling mill as defined in claim 1, wherein:

at least said work roll has a substantially cylindrical configuration.

5. The rolling mill as defined in claim 1, wherein:

at least said support roll has a substantially cylindrical configuration.

6. The rolling mill as defined in claim 1, wherein:

both said work roll and said support roll possess a substantially cylindrical configuration.

* * * * *